US006236006B1

(12) United States Patent
Wecke

(10) Patent No.: US 6,236,006 B1
(45) Date of Patent: May 22, 2001

(54) SWITCH WITH CONTACT TIPS PENETRATING CABLE SHEATH AND CONDUCTORS BY HINGED LID PRESSURE PAD

(75) Inventor: Rolf Wecke, Bückeburg (DE)

(73) Assignee: Bernstein AG, Porta Westfalica (DE)

( * ) Notice: Subject to any disclaimer, the term of this patent is extended or adjusted under 35 U.S.C. 154(b) by 0 days.

(21) Appl. No.: 09/519,098

(22) Filed: Mar. 6, 2000

(30) Foreign Application Priority Data

Mar. 26, 1999 (DE) ..... 299 05 589 U

(51) Int. Cl.[7] ..... H01H 1/58; H01R 4/24
(52) U.S. Cl. ..... 200/284; 439/409
(58) Field of Search ..... 200/16 R, 283, 200/284; 439/409, 410

(56) References Cited

U.S. PATENT DOCUMENTS 2,723,327 * 11/1955 Gilbert ..... 200/298
4,081,641 * 3/1978 Piber ..... 200/284 X
4,351,581 * 9/1982 Wied ..... 439/713
4,612,423 * 9/1986 Munroe ..... 200/16 R X
6,051,801 * 4/2000 Wang ..... 200/284
6,074,239 * 6/2000 Camps ..... 439/409

* cited by examiner

*Primary Examiner*—J. R. Scott
(74) *Attorney, Agent, or Firm*—Henry M. Feiereisen

(57) ABSTRACT

A switch device, includes a casing having an inlet opening for introduction of a conductive cable, having at least two conductors and an insulating sheath. The casing has an open end which is closeable by a lid. Received in the interior of the casing are contact members having terminals which point in the direction of the lid, for penetration through the insulating sheath of the cable and contacting the conductors. A pressure pad is secured interiorly on the lid in an area of contact-making between the contact members and the conductors, for exerting a pressure onto the cable, whereby the pressure pad so projects into the interior of the casing as to firmly press the cable onto the contact members via the connected terminals, when the lid is closed.

9 Claims, 3 Drawing Sheets

SWITCH WITH CONTACT TIPS PENETRATING CABLE SHEATH AND CONDUCTORS BY HINGED LID PRESSURE PAD

CROSS-REFERENCES TO RELATED APPLICATIONS

This application claims the priority of German Patent Application Serial No. 299 05 589.2, filed Mar. 26, 1999, the subject matter of which is incorporated herein by reference.

BACKGROUND OF THE INVENTION

The present invention relates, in general, to a switch device.

To date, switch devices of a type involved here, typically have a casing which is closeable by a lid and provided interiorly with contact members. A conductive cable is guided through an inlet opening into the interior of the casing and has at least two conductors, enclosed by an insulating sheath, for electric connection with the conductive contact members inside the casing.

SUMMARY OF THE INVENTION

It is thus an object of the present invention to provide an improved switch device, which is easy to assemble and cost-efficient and yet realizes a superior electrically conductive contacting between the cable and the contact members.

This object, and others which will become apparent hereinafter, are attained in accordance with the present invention by providing contact members which include terminals, pointing in the direction of the lid, for penetration through the insulating sheath of the cable and contacting the conductors, and by providing a pressure pad, secured interiorly on the lid in an area of contact between the contact members and the conductors, destined for exerting a pressure onto the cable, whereby the pressure pad projects to such an extent into the interior of the casing as to firmly press the cable onto the contact members via the connected terminals, when the lid is closed.

The configuration of a switch device in accordance with the present invention realizes an especially simple assembly of the switch device, in particular as far as the required contacting between the contact members, on the one hand, and the electrically conducting cable, on the other hand, is concerned. After being inserted in the interior of the casing and placed onto the terminals, the cable is slightly pushed against the terminals. A complete and intimate contact is implemented when the lid is closed because the pressure pad, disposed on the inside of the lid, pushes the cable firmly against the terminals. As a consequence, the terminals completely penetrate through the insulating sheath of the cable and contact the conductors within the cable. In this contact-making position, the pressure pad, on the one hand, and the terminals, on the other hand, sufficiently secure the cable in place, at the same time.

The lid is sealed against the casing so as to render the switch device easily suitable for high protective systems while yet reducing manufacturing costs and assembly costs.

According to another feature of the present invention, the pressure pad has a cable-proximal side which is formed with a substantially U-shaped guide groove for, at least partial, engagement of the cable, with the groove having a width substantially corresponding to a width of the cable. As a result, a simple and good lateral securement of the cable is provided. Suitably, the groove has a flank area which expands conically outwards. Thus, even when an installer is not particularly attentive, this configuration ensures that the cable is actually received in the groove, when the lid is closed.

According to still another feature of the present invention, the system of protection can be further enhanced by disposing in the inlet opening a sealing plug which is formed with a bore for feedthrough of the cable and is so compressed by the lid, when the lid is closed, as to seal the bore against the cable.

The lid may be hinged to the casing and may have a hinge-distal edge formed with a locking lug for engaging behind a projecting shoulder of the casing, when the lid is closed. It is also conceivable to secure the lid on the casing via, e.g., several screw fasteners.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
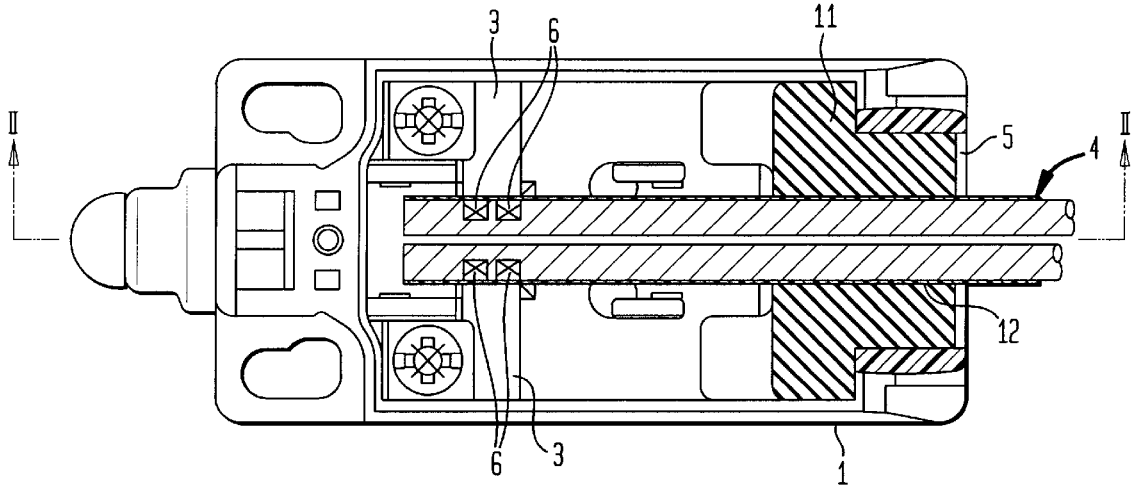
FIG. 1 is a top view of one embodiment of a switch device according to the present invention, with the lid being removed to show the interior of the switch device.

Throughout all the Figures, same or corresponding elements are generally indicated by same reference numerals.

Turning now to the drawing, and in particular to FIG. 1, there is shown a top view of one embodiment of a switch device according to the present invention, including a casing 1 which has an interior accommodating electrically conducting switch contact members 3. The casing 1 has one end face formed with an inlet opening 5 for feedthrough of a cable, e.g. a flat cable, into the interior of the casing 1 and electrically contacting the contact members 3. In the non-limiting example of FIG. 1, the flat cable 4 has a rectangular configuration with two parallel round conductors 7, 8, which are arranged in a plane and accommodated in a ribbon or sheath 24 of flexible insulating plastic. Reference numeral 25 denotes a plunger to operate the switch device, and reference numeral 26 denotes a sealing element to prevent ingress of dirt and moisture into the interior of the casing 1.

Figure 2:
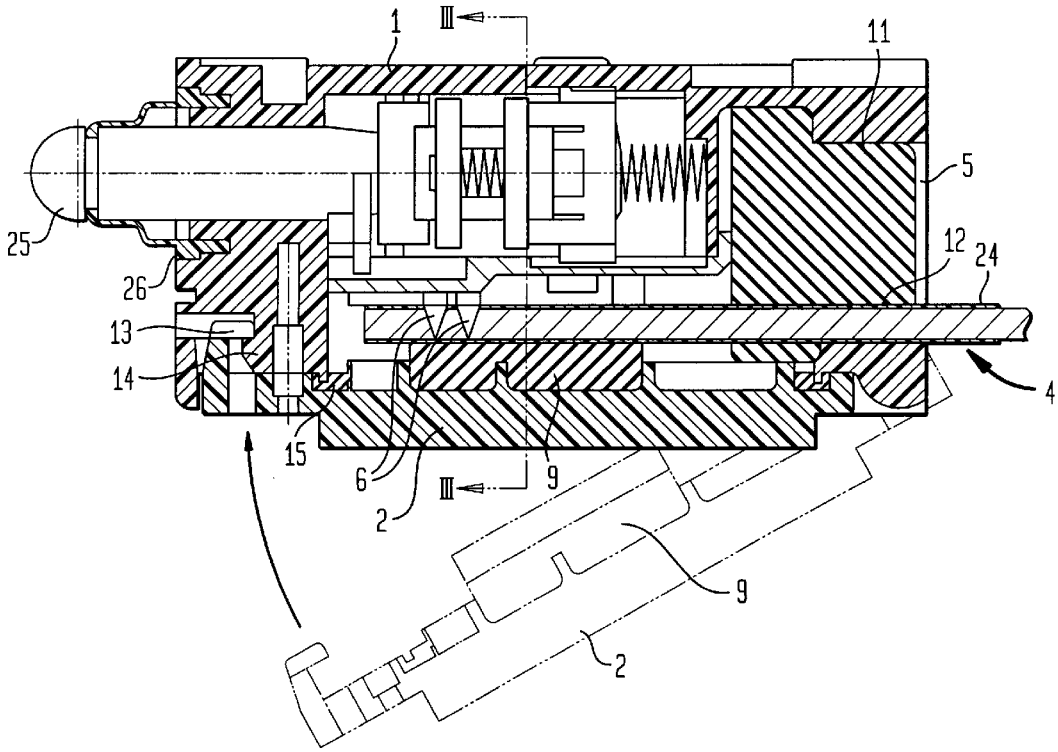
FIG. 2 is a sectional view of the switch device, taken along the line II—II in FIG. 1, showing the lid in closed and open positions.

As shown in conjunction with FIG. 2, which is a sectional view of the switch device, taken along the line II—II in FIG. 1, it can be seen that the casing 1 has an open side which is closeable by a lid 2 having one end hingedly connected to the casing 1 so as to be movable between a closed position, as shown in continuous line, and an open position, as shown in broken line. Instead of a hinged connection, the lid 2 may certainly also be secured in a sealing manner to the casing 1 by other suitable means, without departing from the spirit of the present invention. For example, the attachment of the lid 2 to the casing 1 may be realized via screw fasteners.

It will be appreciated by persons skilled in the art that the switch device must contain much mechanical apparatus, e.g. a switching mechanism, which, however, does not form part of the present invention and thus is not described in more detail for the sake of simplicity. Also, operation of a switch device of this type is generally known and thus is not described in more detail.

Figure 4:
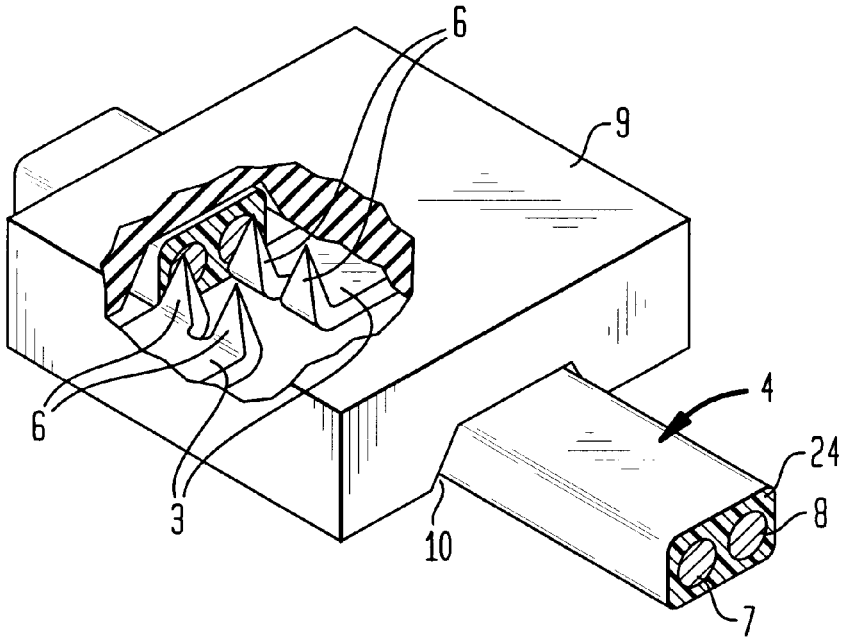
FIG. 4 is a perspective illustration of the switch device of FIG. 1, with the casing being removed and the lid shown by the pressure pad only which has been cut out to show internal components.

The contact members 3 are formed with terminals 6 which project in the direction of the lid 2. As best seen from FIG. 4, two pairs of terminals 6 in confronting disposition are arranged in the casing 1, whereby the terminals 6 are destined to penetrate the sheath 24 of the flat cable 4, when the lid 2 is closed, for contact with the conductors 7, 8, respectively, of the cable 4. Provided on the inside of the lid 2 in the area of contact between the contact members 3 and the conductors 7, 8 is a pressure pad 9, which projects into the interior of the casing 1 to such an extent that the pressure pad 9 is firmly pressed against the terminals 6 of the contact members 3, when the lid 2 is closed.

Figure 3:
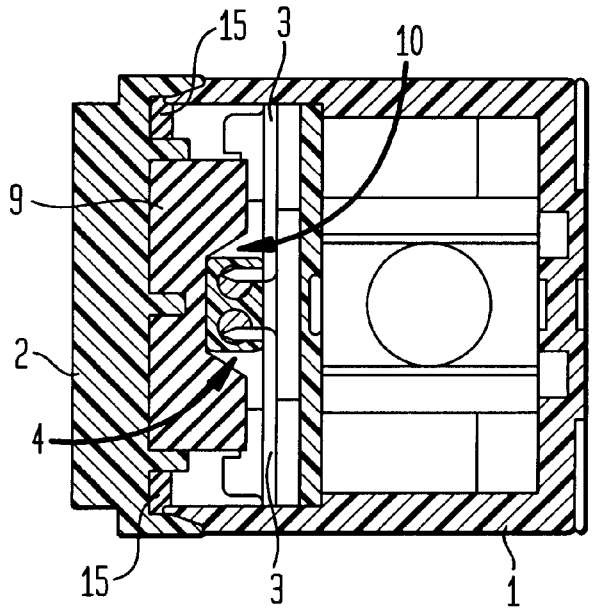
FIG. 3 is a sectional view of the switch device in 90° rotated disposition, taken along the line III—III in FIG. 2.

As shown in FIG. 3, the pressure pad 6 has a cable-proximal side which is formed with a U-shaped guide groove 10 for at least partial engagement of the cable 4. The width of the guide groove 10 approximately corresponds to the width of the cable 4 so as to securely position the cable 4 in place also in lateral direction when the lid 2 is closed. The guide groove 10 expands conically outwards in the area of its lateral flanks to thereby substantially facilitate the placement and fixation of the pressure pad 9 with respect to the cable 4. As further shown in FIG. 3, a continuous seal 15 is provided between the casing 1 and the lid 2 to thereby completely seal the interior of the casing 1 from the outside.

Referring again to FIGS. 1 and 2, the switch device includes a sealing plug 11 which is arranged in the interior of the casing 1 in the area of the inlet opening 5. The sealing plug 11 is formed with a bore 12 for feedthrough of the cable 4. When the lid 2 is closed, the sealing plug 11 is compressed by the lid 2 to such an extent that the bore 12 is sealed against the cable 4.

As shown in particular in FIG. 2, the lid 2 has a free hinge-distal end face which is formed with a locking lug 13 for locked engagement behind a shoulder 14 of the casing 1, when the lid 2 is closed. Thus, the casing 1 can easily be closed and opened.

Figure 5:
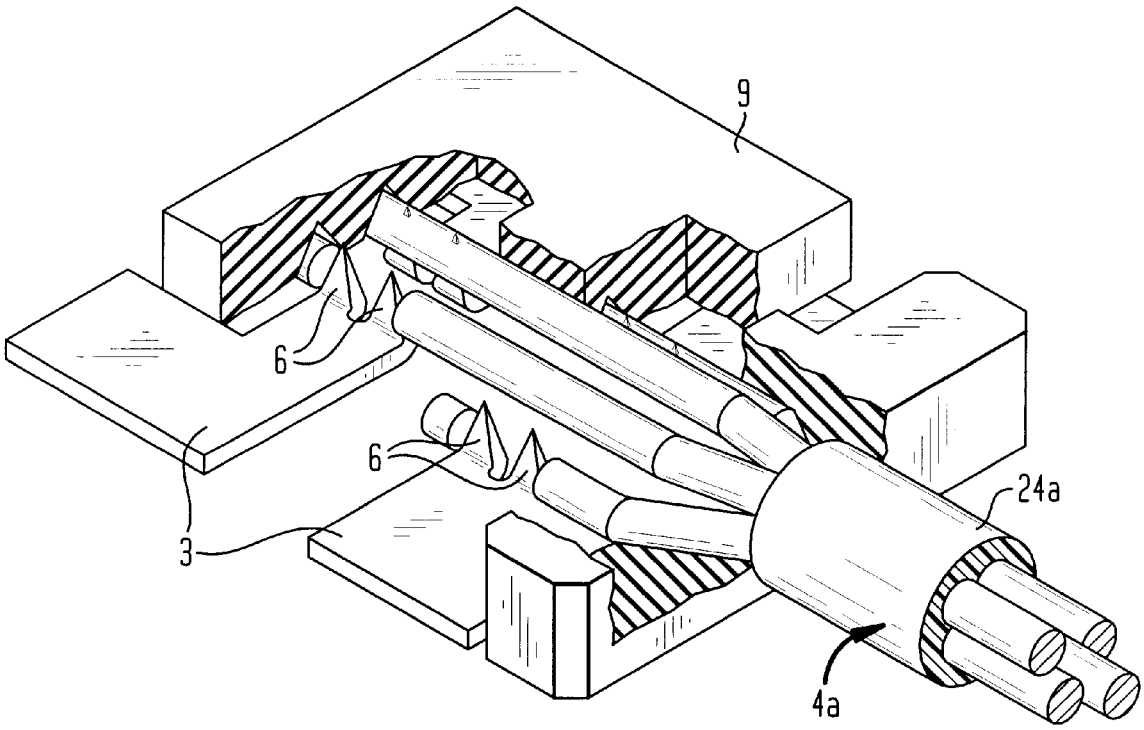
FIG. 5 is a perspective view, similar to FIG. 4, of another embodiment of a switch device according to the present invention.

It is to be understood that the principles described in the preceding description with respect to a flat cable are generally applicable to any other cable configuration as well. An example is shown in FIG. 5, in which a switch device according to the present invention is used in conjunction with a round cable 4*a* having four parallel round conductors arranged in a plane and accommodated in a ribbon or sheath 24*a* of flexible insulating plastic. The terminals 6 of the contact members 3 are arranged in pairs and so placed as to penetrate the cable conductors, respectively, in a manner as described in connection with the embodiment of FIGS. 1 to 4, when the lid 2 is closed, whereby the pressure pad 9 is firmly pressed against the terminals 6 of the contact members 3.

While the invention has been illustrated and described as embodied in a switch device, it is not intended to be limited to the details shown since various modifications and structural changes may be made without departing in any way from the spirit of the present invention.

What is claimed as new and desired to be protected by letters patent is set forth in the appended claims:

What is claimed is:

1. A switch device, comprising:

a casing defining an interior and having an open end, said casing having an inlet opening for introduction of a conductive cable having at least two conductors and an enclosing insulating sheath;

a lid for closing the open end;

contact means received in the interior of the casing and including contact members having terminals which point in the direction of the lid, for penetration through the insulating sheath of the cable and contacting the conductors; and pressure application means, secured interiorly on the lid in an area of contact between the contact members and the conductors, for exerting a pressure onto the cable, said pressure application means including a pressure pad which so projects into the interior of the casing as to firmly press the cable onto the contact members via the connected terminals, when the lid is closed.

2. The switch device of claim 1 wherein the pressure pad has a cable-proximal side which is formed with a substantially U-shaped guide groove for, at least partial, engagement of the cable, said guide groove having a width substantially corresponding to a width of the cable.

3. The switch device of claim 2 wherein the guide groove has a flank area which expands conically outwards.

4. The switch device of claim 1, and further comprising a sealing plug disposed in the inlet opening and formed with a bore for feedthrough of the cable, said sealing plug being compressed by the lid, when the lid is closed, so as to seal the bore against the cable.

5. The switch device of claim 1, and further comprising a seal extending continuously between the casing and the lid.

6. The switch device of claim 1 wherein the lid is hinged to the casing.

7. The switch device of claim 1, and further comprising connecting means for detachably securing the lid to the casing.

8. The switch device of claim 1 wherein the connecting means includes screw fasteners.

9. The switch device of claim 1 wherein the lid includes a locking lug engaging behind a shoulder of the casing to thereby securely close the casing.

* * * * *